US008654615B2

(12) United States Patent
Lin

(10) Patent No.: US 8,654,615 B2
(45) Date of Patent: Feb. 18, 2014

(54) TIMER MOVEMENT WITH A DISPLAY FOR WORLD TIME ZONES

(75) Inventor: Wen-Chun Lin, New Taipei (TW)

(73) Assignee: Atop Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/595,886

(22) Filed: Aug. 27, 2012

(65) Prior Publication Data

US 2013/0100780 A1 Apr. 25, 2013

(30) Foreign Application Priority Data

Oct. 21, 2011 (TW) ..... 100138210 A

(51) Int. Cl.
*G04B 19/22* (2006.01)
*G04B 19/23* (2006.01)

(52) U.S. Cl.
CPC ..... *G04B 19/22* (2013.01); *G04B 19/225* (2013.01); *G04B 19/23* (2013.01)
USPC ..... 368/27

(58) Field of Classification Search
USPC ..... 368/21–23, 27
See application file for complete search history.

(56) References Cited

U.S. PATENT DOCUMENTS

| | | | | |
|---|---|---|---|---|
| 3,633,354 | A * | 1/1972 | Stemmler | 368/27 |
| 5,541,895 | A * | 7/1996 | Nussbaum | 368/295 |
| 5,708,628 | A * | 1/1998 | Chen | 368/21 |
| 5,822,279 | A * | 10/1998 | Cuche et al. | 368/295 |
| 6,636,457 | B2 * | 10/2003 | Lin | 368/21 |
| 7,639,568 | B2 * | 12/2009 | Lin | 368/22 |
| 7,826,311 | B2 * | 11/2010 | Lin | 368/22 |
| 8,036,066 | B2 * | 10/2011 | Schlencker et al. | 368/22 |

* cited by examiner

*Primary Examiner* — Vit W Miska
(74) *Attorney, Agent, or Firm* — Guice Patents PLLC

(57) ABSTRACT

The present invention relates to a timer movement with a display for world time zones. While operating, by aligning the landmark of local time zone with a fixed point for calibrating the local time, then turning a time zone adjustable ring to the landmark of another time zone to be aligned with the fixed point, an inner gear ring of the time zone adjustable ring can drive a planetary idle gear, a planetary driven gear and a planetary base gear to rotate, and each elastic positioning ball is sequentially buckled and positioned along each positioning hole, and a first front hour wheel is enabled to perform planetary motion about a first minute wheel set on the planetary base gear, so as to rotate the first hour wheel meshed therewith for displacing a first hour hand to display the time of first location at the landmark of another time zone.

14 Claims, 10 Drawing Sheets

TIMER MOVEMENT WITH A DISPLAY FOR WORLD TIME ZONES

BACKGROUND OF THE INVENTION

1. Field of the Invention

The present invention relates to a timer movement, especially to a timer movement with a display for world time zones.

2. Description of Related Art

It is know that the internal exchange is getting more frequent and the transnational contact is getting popular due to the advance of the traffic and communication. In order to consider the factor with regard to the transmission of information and to the time difference, a clock possible to show the time of other time zones, or the so-called world time clock is developed for satisfying the needs.

Mostly, a conventional world time clock at the dial thereof is printed with a world map and a local time is looked up in the world map. The shortage involved in the conventional world time clock is that the dial appears too much complicated and it does not fulfill the criterion of human engineering from the standpoint of vision cognition and transmission.

For meeting the needs of displaying world time zones required by business men, the inventor of the present invention has developed a series of timer movement with a display for world time zones, for example the Taiwan Patent No. 480375 (equivalent to the China Patent No. 01120668.3, the U.S. Pat. No. 6,636,457, the European Patent No. EP 1291738 B1), the Taiwan Patent No. 1305873 (equivalent to the China Patent No. 200610075120.3, the U.S. Pat. No. 7,639,568), and the Taiwan Patent No. 1322933 (equivalent to the China Patent No. 200710079235.4, the U.S. Pat. No. 7,826,311). Each disclosed timer movement can be respectively applied in a clock, alarm or watch, and with the special design of adjusting the time zone with an intuitive manner, the developed products are very popular in domestic and international markets.

Each mentioned timer movement comprises a power source, a second counter, a minute counter, an hour counter and a time zone display. By turning a time zone adjustable ring installed on the time zone display, a first landmark of the local time zone is aligned with a fixed point for calibrating the local time, then turning the time zone adjustable ring to a second landmark of another time zone to the fixed point; at this moment, an inner gear ring of the time zone display drives a planetary idle gear and a planetary base gear to rotate, such that engaging hooks are in sequence buckled and positioned along each unidirectional ratchet hole, and a front hour wheel performs planetary motion about a minute wheel set on the planetary base gear for enabling an hour wheel meshed therewith to rotate, so as to displace an hour hand to the time in accordance with the time zone corresponding to the second landmark.

In addition, in each mentioned timer movement, at least two engaging hooks preset at the bottom of a substrate are respectively and sequentially buckled and positioned with plural unidirectional ratchet holes annularly arranged inside the time zone adjustable ring, or at least two engaging hooks preset at the bottom of a substrate are respectively and sequentially buckled and positioned with plural unidirectional ratchet holes annularly arranged at the top of the time zone adjustable ring; with the arrangement, the time zone adjustable ring is only provided with a unidirectional rotating and positioning function, so for the operation and selection of time zones, there is still some room for improvement.

SUMMARY OF THE INVENTION

One primary objective of the present invention is to provide a timer movement with a display for world time zones, wherein its time zone adjustable ring is provided with a bidirectional rotating and positioning function, which can be utilized to rapidly adjust to a desired time zone, and immediately display the time of the specified time zone, thereby providing convenience in use.

For achieving the mentioned objective, one technical solution provided by the present invention is to provide a timer movement with a display for world time zones, which comprises a power source, a second counter, a minute counter, an hour counter and a time zone display, so as to display a correct time of a specified time zone on a faceplate. Wherein, the second counter drives a front minute wheel of the minute counter to rotate, the front minute wheel meshes with a first minute wheel set pivoted on a fasten base and having a first minute hand; a time zone adjustable ring of the time zone display is disposed between the fasten base and a faceplate, and a planetary idle gear and a planetary driven gear are pivoted on the faceplate and mutually meshed, The planetary idle gear and the planetary driven gear are respectively engaged with an inner gear ring of the time zone adjustable ring and a planetary base gear pivoted at the central bottom of the fasten base, the planetary base gear allows the first minute wheel set to pass over and meshes with a first front hour wheel of the hour counter pivoted at the bottom of the planetary base gear. The first front hour wheel further meshes with a first hour wheel pivoted on the faceplate and having a first hour hand; and the periphery of a round disk at the bottom of the fasten base is radially or axially formed with a plurality of sleeve holes, at least two elastic positioning balls are sleeved and positioned in the selected sleeve holes, the periphery of inner wall or the bottom periphery of the time zone adjustable ring is annularly and equiangularly formed with 24 positioning holes for buckling and positioning the elastic positioning balls, such that the time zone adjustable ring is enabled to bidirectionally rotate.

By aligning the landmark of local time zone with a fixed point for calibrating the local time, then turning the time zone adjustable ring to the landmark of another time zone to be aligned with the fixed point, the inner gear ring of the time zone adjustable ring can drive the planetary idle gear, the planetary driven gear and the planetary base gear to rotate, and each elastic positioning ball is sequentially buckled and positioned along each positioning hole, and the first front hour wheel is enabled to perform planetary motion about the first minute wheel set on the planetary base gear, so as to rotate the first hour wheel meshed therewith for displacing the first hour hand to display the time of first location at the landmark of another time zone.

Another objective of the present invention is to provide a timer movement with a display for world time zones, which is not only equipped with a function of immediately displaying the time is each world time zone, but also includes displaying time of second location of another time zone, such that the timer movement has a functional of synchronously displaying time at two different locations.

For achieving the mentioned objective, the present invention further provides a second minute wheel set meshed with the front minute wheel of the minute counter, pivoted on the fasten base and having a second minute hand, the second minute wheel set further meshes with a second front hour wheel pivoted on the fasten base, the second front hour wheel further meshes with a second hour wheel pivoted on the fasten base and penetrating the faceplate and having a second hour hand, so as to display the time of second location.

DETAILED DESCRIPTION OF THE PREFERRED EMBODIMENT

Figure 1A:
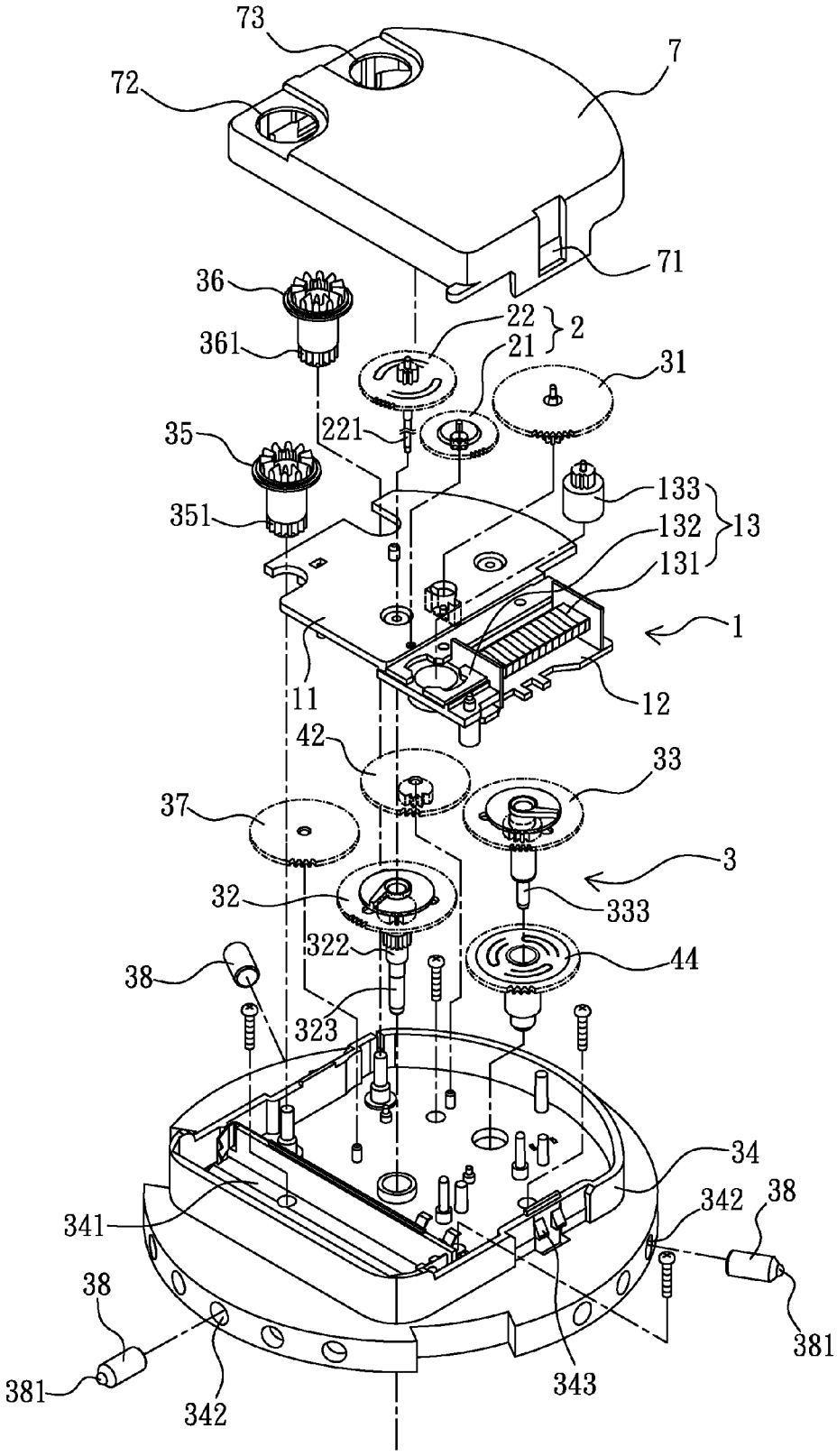
FIG. 1*a* and FIG. 1*b* are perspective exploded views illustrating the timer movement, according to the present invention.
Figure 1B:
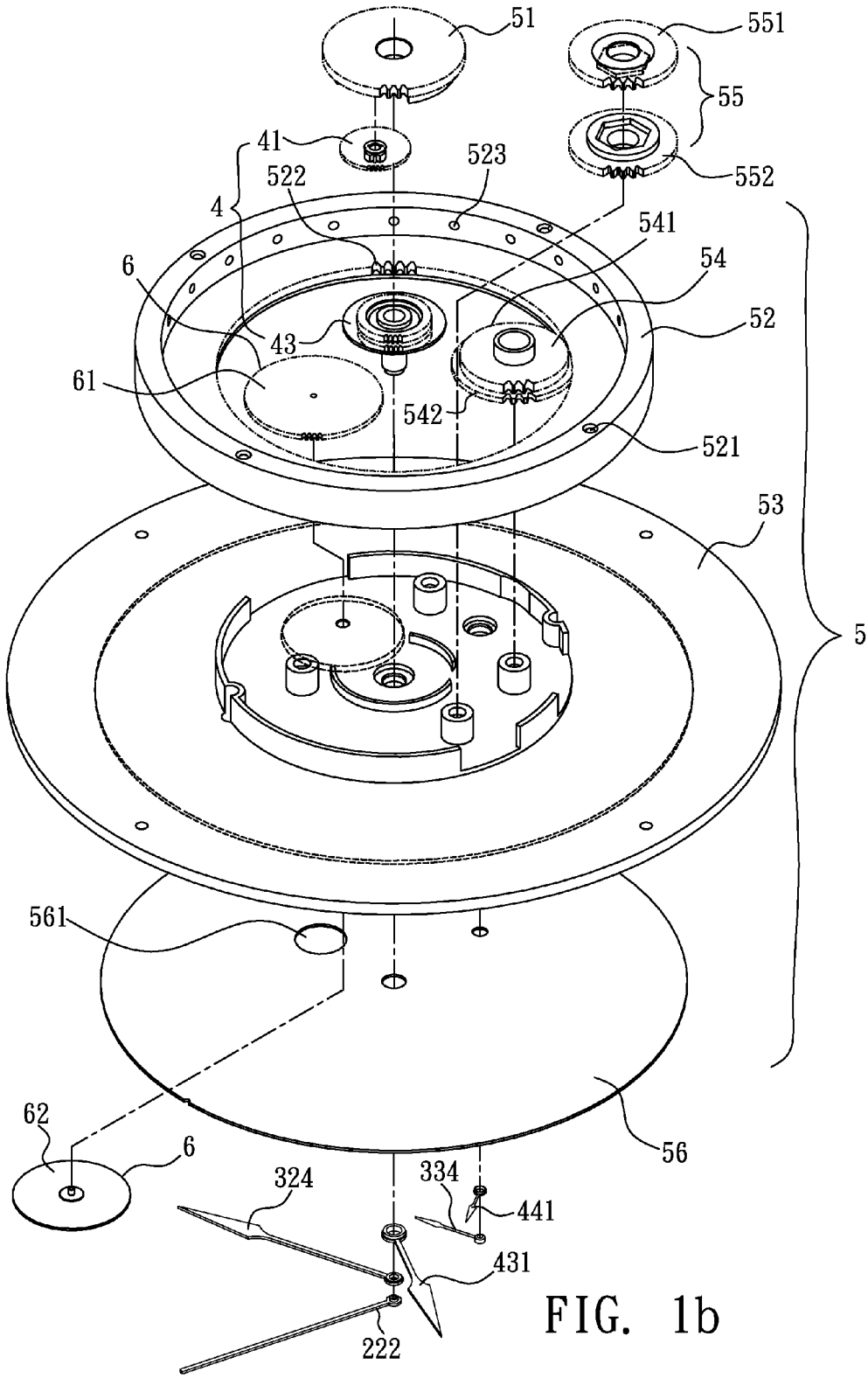
Figure 2A:
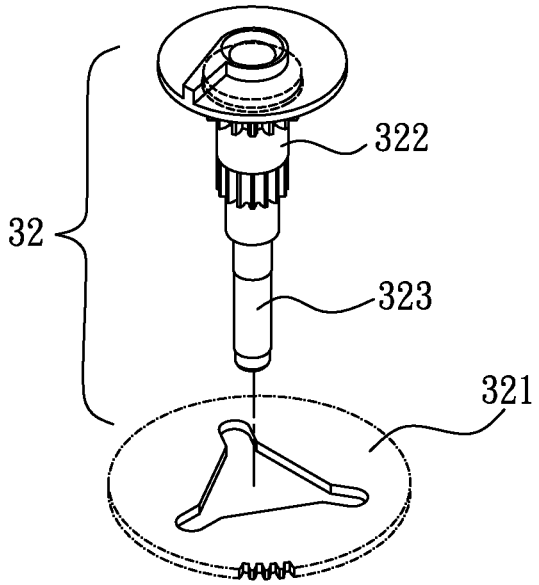
FIG. 2*a* and FIG. 2*b* are perspective exploded views illustrating the first minute wheel set and the second minute wheel set, according to the present invention.
Figure 2B:
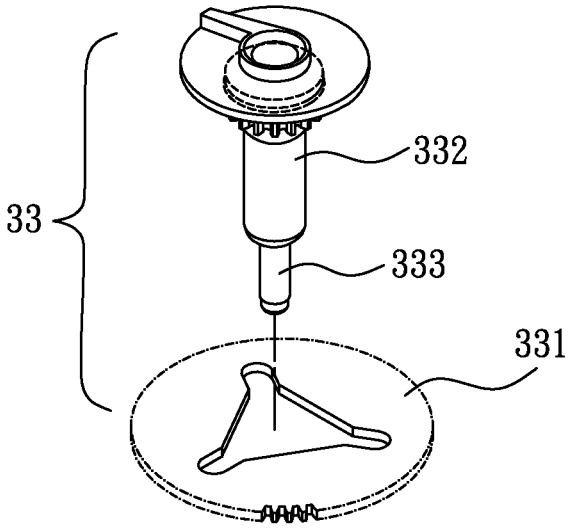
Figure 3:
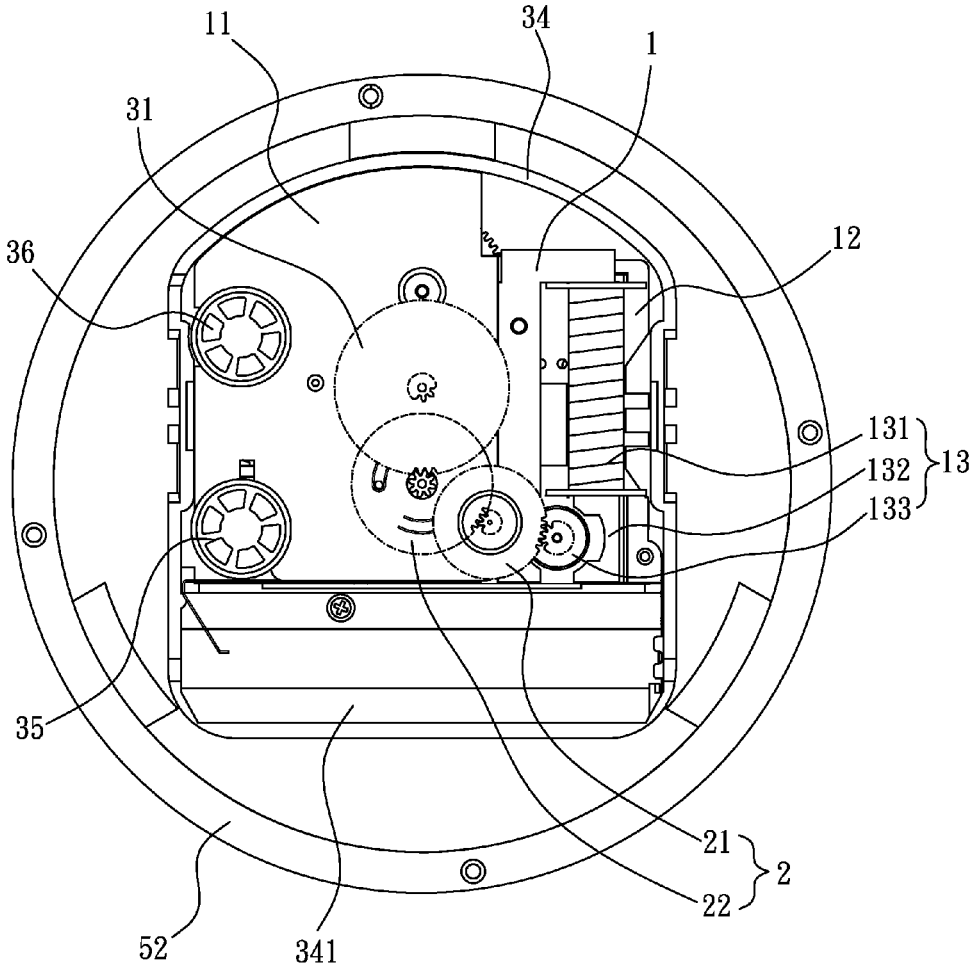
FIG. 3 is a schematic view illustrating the assembly after each component being installed on the top of the substrate, according to the present invention.
Figure 4:
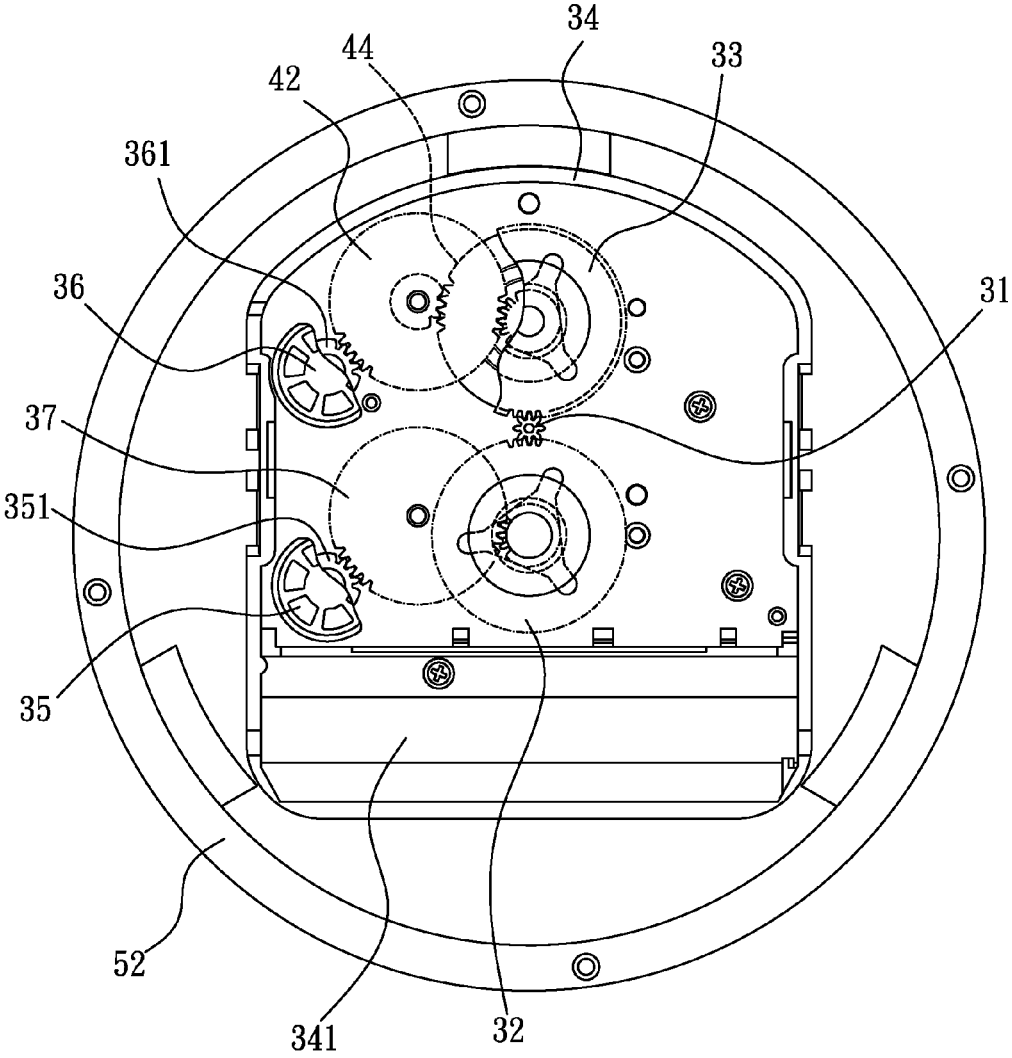
FIG. 4 is a schematic view illustrating the assembly after each component being installed on the top of the fasten base, according to the present invention.
Figure 5:
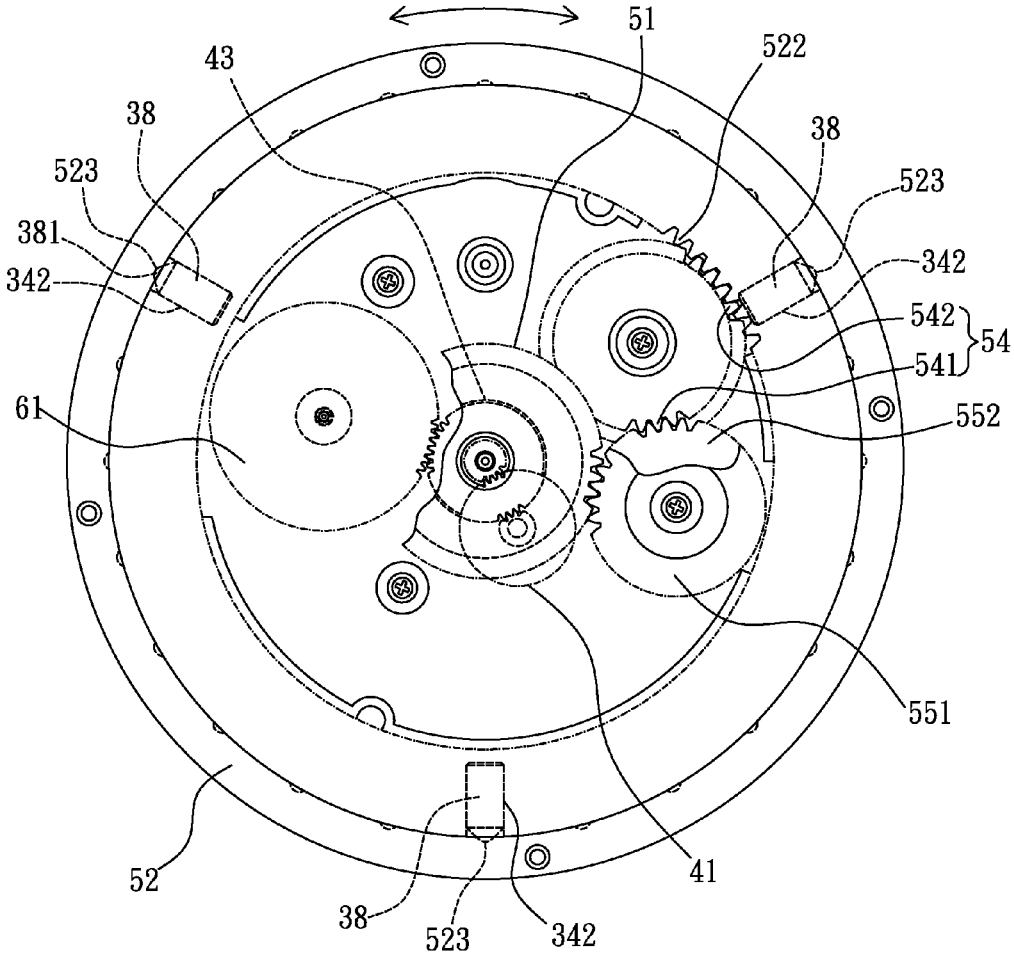
FIG. 5 is a schematic view illustrating the assembly after each component being installed on the top of the faceplate, according to the present invention.
Figure 6:
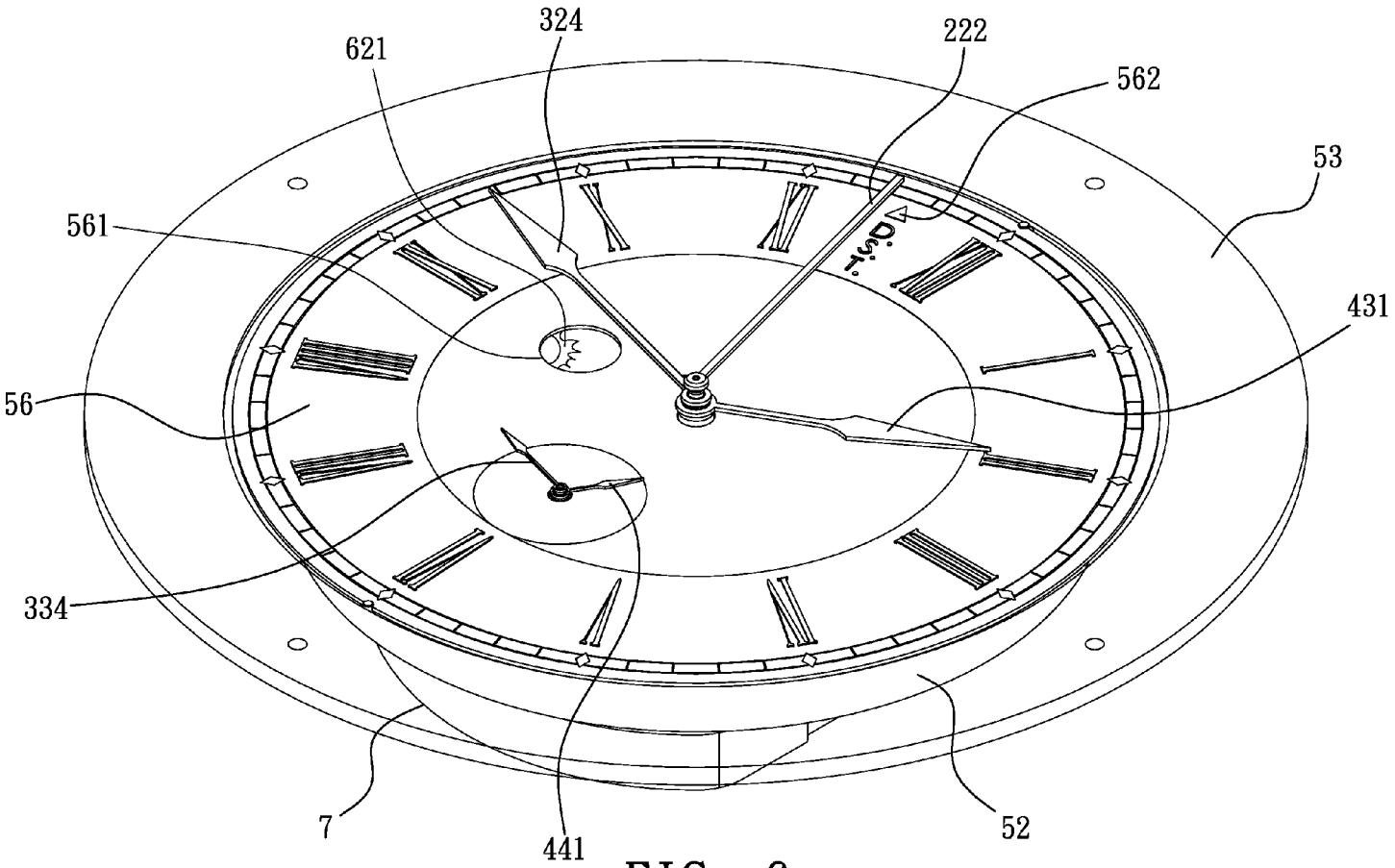
FIG. 6 is a perspective view illustrating the assembly of the timer movement, according to the present invention.
Figure 7:
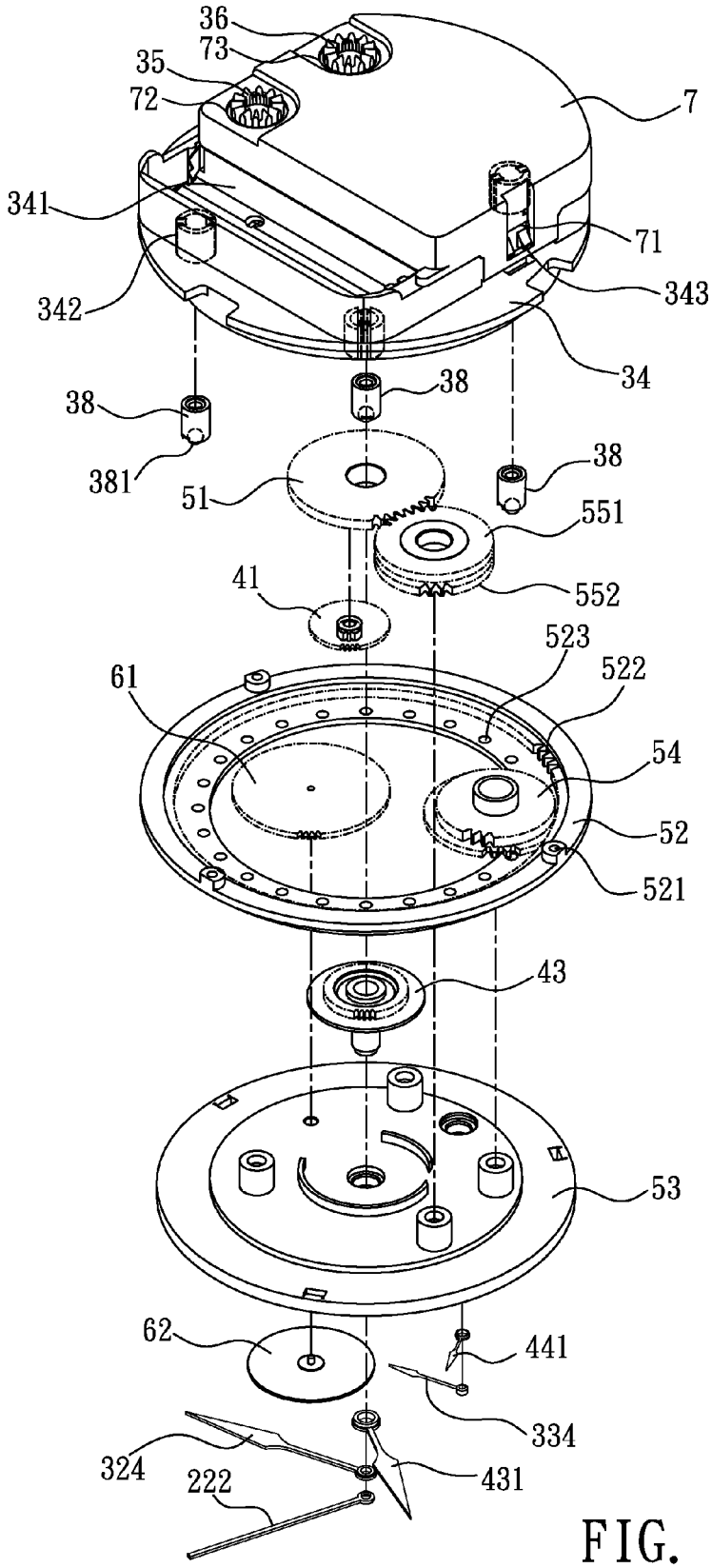
FIG. 7 is a partially perspective exploded view illustrating the timer movement, according to the second embodiment of the present invention.
Figure 8:
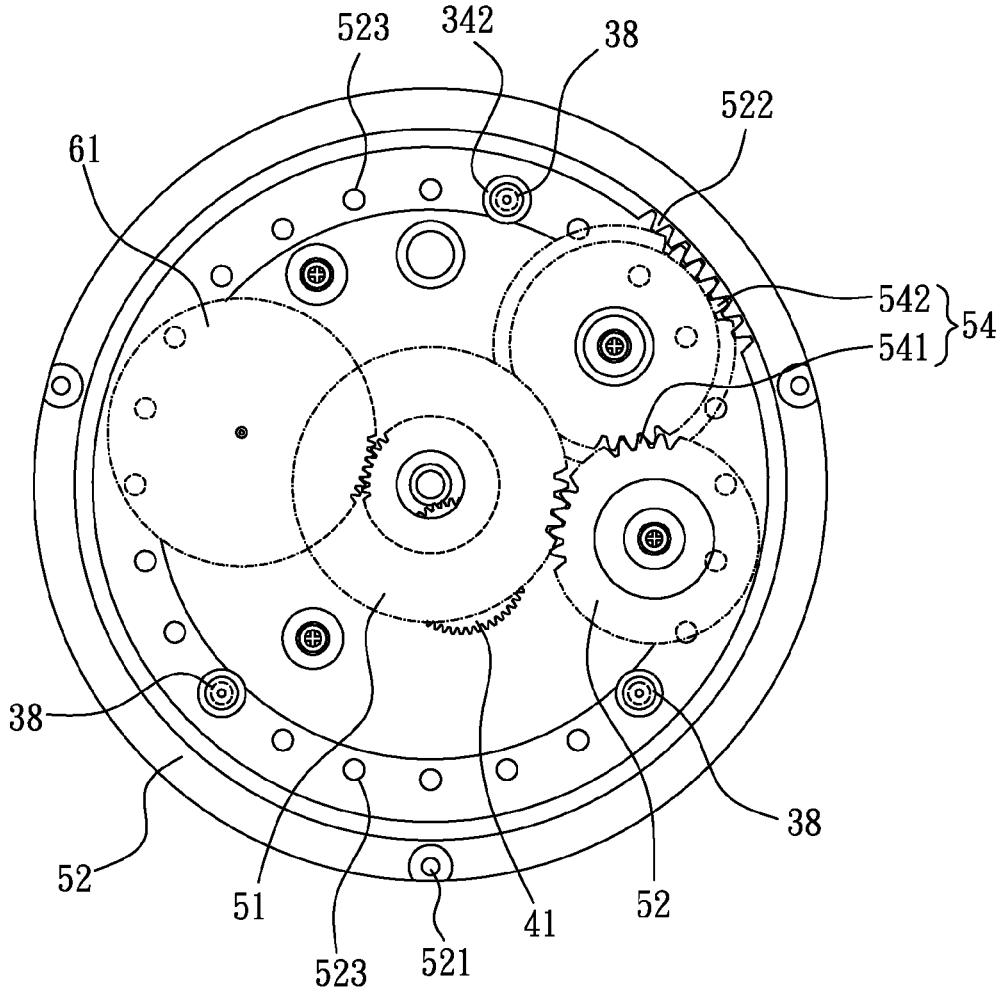
FIG. 8 is a schematic view illustrating the assembly after each component being installed on the top of the faceplate of the timer movement of FIG. 7, according to the second embodiment of the present invention.
Figure 9:
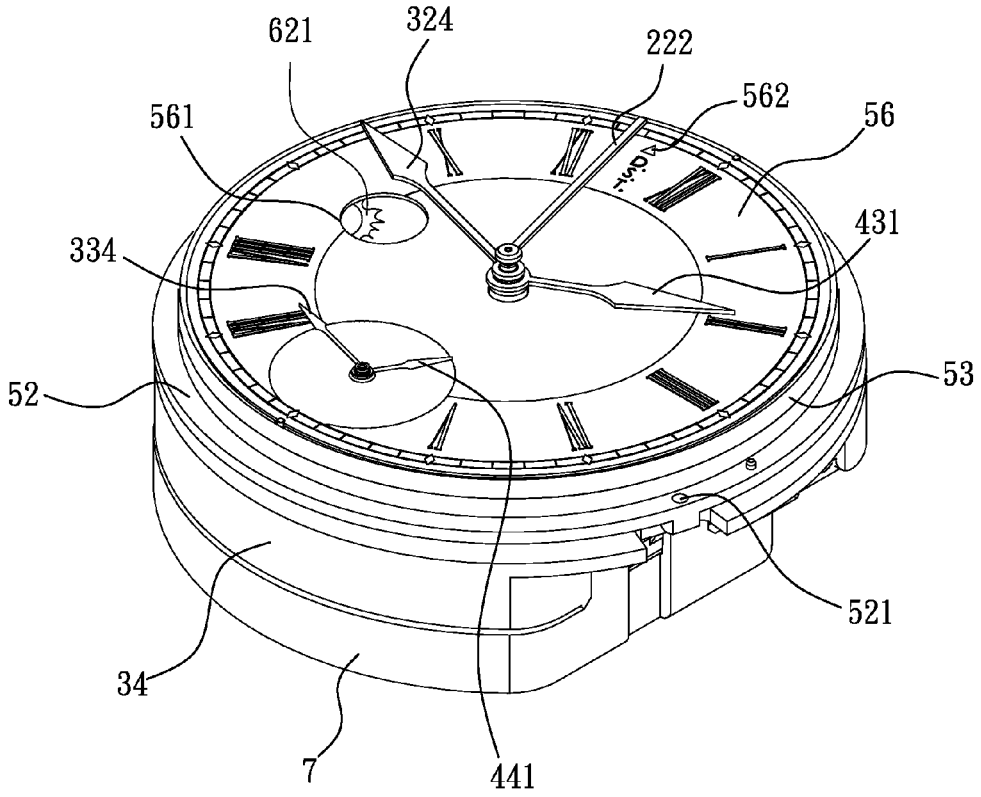
FIG. 9 is a perspective view illustrating the assembly of the timer movement, according to the second embodiment of the present invention.

The accompanying drawings are included to provide a further understanding of the invention, and are incorporated in and constitute a part of this specification. The drawings illustrate embodiments of the invention and, together with the description, serve to explain the principles of the invention, wherein FIG. 1*a* and FIG. 1*b* are perspective exploded views illustrating the timer movement, according to the present invention; FIG. 2*a* and FIG. 2*b* are perspective exploded views illustrating the first minute wheel set and the second minute wheel set, according to the present invention; FIG. 3 is a schematic view illustrating the assembly after each component being installed on the top of the substrate, according to the present invention; FIG. 4 is a schematic view illustrating the assembly after each component being installed on the top of the fasten base, according to the present invention; FIG. 5 is a schematic view illustrating the assembly after each component being installed on the top of the faceplate, according to the present invention; FIG. 6 is a perspective view illustrating the assembly of the timer movement, according to the present invention; FIG. 7 is a partially perspective exploded view illustrating the timer movement, according to the second embodiment of the present invention; FIG. 8 is a schematic view illustrating the assembly after each component being installed on the top of the faceplate of the timer movement of FIG. 7, according to the second embodiment of the present invention; and FIG. 9 is a perspective view illustrating the assembly of the timer movement, according to the second embodiment of the present invention.

Please refer from FIG. 1*a* to FIG. 6, the timer movement according to the present invention substantially comprises a power source 1, a second counter 2, a minute counter 3, an hour counter 4, and a time zone display 5. In addition, the timer movement of the present invention further comprises a day-night display 6.

As shown in FIG. 1*a*, FIG. 3 and FIG. 4, the power source 1 is fixed at a lateral side of a substrate 11 and is provided with a circuit board 12 which is connected to a battery, so as to supply electric power to a conventional stepping motor 13 composed of a coil 131, a stator 132, and a rotor 133 for enabling the rotor 133 to rotate with a constant speed and transmit the power to the second counter 2.

The second counter 2 is provided with a front second wheel 21 axially attached to the substrate 11 and meshed with the rotor 133 so as to be driven by the rotor 133. The front second wheel 21 further meshes with a second wheel 22 so that the second wheel 22 can rotate a revolution per minute. The bottom of the second wheel 22 is downwardly extended with a second spindle 221 protruding on a faceplate 53 and connected with a second hand/disk 222.

The minute counter 3 is provided with a front minute wheel 31 pivoted to the substrate 11 and meshed with the second wheel 22, and the lower part of front minute wheel 31 passes over the substrate 11 to respectively mesh with a first minute wheel set 32 and a second minute wheel set 33 disposed on a fasten base 34, so as to obtain an effect of speed reduction. The bottoms of the first and the second minute wheel sets 32, 33 are respectively extended with a first and a second minute spindle 323, 333. The first and the second minute spindles 323, 333 respectively pass through a center hole and a side hole defined nearby the periphery of the fasten seat 34 and a faceplate 53 so as to protrude on the faceplate 53, then are respectively sleeved with a first minute hand 324 and a second minute hand 334, such that the first and the second minute hands 324, 334 can turn 6° per revolution of the second hand/disk 24.

Please refer from FIG. 1*a* to FIG. 2*b*, the first and the second minute wheel sets 32, 33 are respectively provided with a first and a second minute wheels 321, 331 moveably fitted with a first and a second minute wheel spindles 322, 332. An advantage of this arrangement is that, when a first or a second adjustment knob 35, 36 exposed out of a cover plate 7 and pivoted at the top of the fasten base 34 is turned, a first or a second driven wheel 351, 361 at the bottom of each adjustment knob 35, 36 is rotated, such that a relay wheel 37 and a second front hour wheel 42 meshed with the first and the second driven wheels 351, 361 are driven to rotate, thereby causing a relative motion between the first and the second minute wheel sets 32, 33 and the hour counter 4, for obtaining a purpose of time adjustment. Wherein, the first and the second minute wheels 321, 331 turn in a state of idling in spite of being driven by the front minute wheel 31, so the second spindle 221 keeps turning with a constant speed to avoid a possible error resulting from a stop of the second spindle 221 during the time correction.

In addition, after being assembled with the mentioned component, the substrate 11 is disposed at the top of the fasten base 34, such that the above two are prevented from separating. Moreover, the top of the fasten base 34 is additionally installed with a battery chamber 341 electrically connected to the circuit board 12 for allowing a battery to be accommodated (not shown in figures), so as to provide electric power to the circuit board 12. Besides, the periphery of a round disk at the bottom of the fasten base 34 is concentrically formed with plural sleeve holes 342 arranged with equal angles, then at least two elastic positioning balls 38, e.g. three elastic positioning balls 38, are radially and equiangularly sleeved in the selected sleeve holes 342 so as to be positioned, such that ball bodies 381 are exposed out of the sleeve holes 342.

As shown FIG. 1*b* and FIG. 5, the hour counter 4 is pivoted with a planetary base gear 51 at the central bottom of the fasten base 34, the bottom of the planetary base gear 51 is pivoted with a first front hour wheel 41, which meshes with a first minute wheel spindle 322 passing over the fasten base 34 and the planetary base gear 51 so as to synchronously rotate and linked with the planetary base gear 51 to perform planetary motion. In addition, the first front hour wheel 41 meshes with a first hour wheel 43 pivoted at the top of the faceplate 53, such that the speed of the first hour wheel 43 can be reduced to turn 30° per 60 minutes. The first hour wheel 43 penetrates the faceplate 53 then is pivoted to a first hour hand 431 for representing a time of first location.

Please refer to FIG. 1*a* and FIG. 4, the second minute wheel set 33 passes over a second hour wheel 44, and the second front hour wheel 42 meshes with the second hour wheel 44 on the fasten base 34, such that the speed of the second hour wheel 44 can also be reduced to turn 30° per 60 minutes. The second hour wheel 44 penetrates the faceplate 53 and is pivoted to a second hour hand 441 for representing a time of second location.

Please refer to FIG. 1*b* and FIG. 5, the time zone display 5 is pivoted to the planetary base gear 51 at the central bottom of the fasten base 34, a center hole of the planetary base gear 51 allows the first minute wheel spindle 322 to pass through so as to mesh with the first front hour wheel 41 pivoted at the bottom of the planetary base gear 51. In addition, a time zone adjustable ring 52 is rotatably disposed between the fasten base 34 and the faceplate 53, wherein the time zone adjustable ring 52 has a plurality of connecting portions 521, for example screws, to connect with a landmark ring (not shown in figures) which has carried thereon typical city names corresponding to 24 time zones; or the connecting portions 521 are connected with a support by using screws, so as to connect to a spherical globe which has carried thereon typical city names corresponding to 24 time zones.

The time zone adjustable ring 52 has an inner gear ring 522 and the periphery of inner wall is annularly formed with 24 positioning holes 523 arranged with equal angles for allowing the ball bodies 381 of the at least two elastic positioning balls 38 to be buckled and positioned. The inner gear ring 522 meshes with a planetary idle gear 54, which axially connects with the faceplate 53 at a circumferential opening thereof. In addition, a planetary driven gear 55, which is pivoted at the top of the faceplate 53, meshes between the planetary base gear 51 and the planetary idle gear 54 thereby forming a linkage relation. Wherein, the planetary driven gear 55 is composed of a bottom driven gear 551 being sleeved with a top driven gear 552 at the top, wherein the bottom and the top driven gears 551, 552 respectively mesh with the planetary base gear 51 and a top gear plate 541 of the planetary idle gear 54, and a bottom gear plate 542 of the planetary idle gear 54 meshes with the inner gear ring 522 of the time zone adjustable ring 52.

As such, when the time zone adjustable ring 52 is turned to a specified time zone, the planetary idle gear 54 rotates with the planetary driven gear 55, so the planetary base gear 51 can be driven by the planetary driven gear 55 to rotate, and the first front hour wheel 41 performs planetary motion along the planetary base gear 51, and the first hour wheel 43 can be turned for driving the first hour hand 431 on the faceplate 53 to synchronously rotate, so as to display the time in the specified time zone.

In addition, the first front hour wheel 41 rotates about the first minute wheel spindle 322 while the planetary base gear 51 is performing the planetary motion, so that it is not possible to generate an error of time reading.

Besides, the periphery of inner wall of the time zone adjustable ring 52 is annularly and equiangularly formed with 24 positioning holes 523 which are corresponding to the typical city names of 24 time zones on the landmark ring, or the positioning holes 523 are corresponding to the spherical globe which has carried thereon typical city names corresponding to 24 time zones. As such, when the time zone adjustable ring 52 is turned, a bidirectional rotating state with normal or reverse rotation can be formed according to the distance relation with respect to a selected time zone; and by selectively buckling the at least two elastic positioning balls 38 radially formed on the fasten base 34 into the positioning holes 523, functions of performing a sharp pause and positioning at an exact hour location are provided.

Please refer to FIG. 1*b* and FIG. 6, the present invention further comprises a day-night display 6, which is possible for being known the state of daytime or the state of nighttime if it is necessary. The day-night display 6 is provided with a day-night gear 61, which is pivoted to the substrate 11 and meshed with the first hour wheel 43. The day-night gear 61 can rotate along the first hour wheel 43. Wherein, the day-night gear 61 is pivoted with a day-night display disk 62 at the bottom of the faceplate 53 and having a decoration mark 621 (please refer to FIG. 6) as a symbol to indicate the state of daytime or the state of nighttime. Due to engaging with the first hour wheel 43 constantly, the day-night gear 61 and the day-night display disk 62 run along with the first hour wheel 43 so that the situations of day and night with regard to the local time of the user can be shown under a normal state. When the user turns the time zone adjustable ring 52 with hand, the first hour wheel 43 may generate an opposite rotation and the day-night gear 61 further turns along with the first hour wheel 43. While adjusting to a desired time zone, the decoration mark 621 of the day-night display disk 62 represents the situation of day-night of the local time. Thus, the 12-hour movement disclosed in the present invention can distinguish the state of daytime from the state of nighttime and display the time corresponding to the respective state.

Furthermore, in order to enhance the appearance of the faceplate 53, the bottom thereof can be provided with an ornament plate 56 marked with time scales or decorative patterns. As shown in FIG. 6, the ornament plate 56 is provided with time scales, for example display of hour, minute and second, and a round viewing window 561 for observing the situations of daytime or nighttime displayed by the decoration mark 621 of the day-night display disk 62. The second spindle 221, the first minute spindle 323 and the first hour wheel 43 penetrating the center holes of the faceplate 53 and the ornament plate 56 are respectively connected to a second hand/disk 222, a first minute hand 324 and a first hour hand 431, so as to display the time of first location. The second minute spindle 333 and the second hour wheel 44 also penetrate the side holes preset nearby the peripheries of the faceplate 53 and the ornament plate 56, and are respectively connected to the second minute hand 334 and the second hour hand 441, so as to display the time of second location.

As a matter of fact, under a circumstance that the output power of power source 1 is sufficient enough, the front minute wheel 31 can further mesh with and transmit at least a minute wheel set, e.g. a third minute wheel set, at least a hour wheel set, e.g. a third front hour wheel, at least a hour wheel, e.g. a third hour wheel, and work with at least an adjustment knob, at least a minute hand and an hour hand, e.g. a third adjustment knob, a third minute hand and a third hour hand, so as to expand the time displaying on the faceplate 53, e.g. the time of third location or even more.

The cover plate 7 is combined on the fasten base 34, for example two lateral walls of the cover plate 7 and the fasten base 34 are oppositely provided with buckle slots 71 and buckle hooks 343 capable of being mutually buckled, so as to fasten on the substrate 11 of the fasten base 34 for the purpose of sealing. Wherein, the top of the cover plate 7 is respectively formed with a first and a second through holes 72, 73 corresponding to the locations of the first and the second adjustment knobs 35, 36 for allowing the first and the second adjustment knobs 35, 36 to be exposed, such that the user can adjust the time of first and second locations.

As shown in FIG. 6, which is a perspective view showing the assembly of the timer movement, according to the present invention; please also refer to FIG. 1*b* and FIG. 5, the plural connection portions 521 of the time zone adjustable ring 52 can be connected to a landmark ring which has carried thereon typical city names corresponding to 24 time zones; or through connecting to the support, the plural connection portions 521 of the time zone adjustable ring 52 can be connected to a spherical globe which has carried thereon typical city names corresponding to 24 time zones. By turning the landmark ring or the spherical globe, the time zone adjustable ring 52 can be driven to rotate, and the positioning holes 523 formed at the periphery of inner wall are sequentially buckled and positioned with the elastic positioning balls 38 radially arranged at the periphery of the fasten base 34, such that time at other time zones can be immediately read.

When the present invention is in use, the user aligns the local time zone of the landmark ring or the spherical globe, for example the local landmark of Taipei, to a fixed point such as the 12 o'clock and then the first adjustment knob 35 is turned for enabling the first driven wheel 351 to drive the relay wheel 37, the first minute wheel set 32 and the first hour wheel 43, so as to calibrate in accordance with the location time. Next, the displayed time can be determined whether it is in the daytime or nighttime by reading the decoration mark 621 of the day-night display disk 62 driven by the day-night gear 61 on the faceplate 53, such as the time being adjusted to 12 o'clock at noon. In order to look into another time zone such as the time in Chicago, it is only necessary to turn the landmark ring or the spherical globe for enabling the inner gear ring 522 of the time zone adjustable ring 52 to drive the planetary idle gear 54, the planetary driven gear 55, the planetary base gear 51, the first front hour wheel 41 and the first hour wheel 43 to synchronously rotate, and the landmark of Chicago is aligned with the direction of 12 o'clock such that the day-night display disk 62 shows a decoration mark 621 representing the night at the present time with the first hour hand 431 indicating 10 o'clock and it means the present time in Chicago is 10 o'clock at night, which is not appropriate to make a business phone call.

If local daylight saving time is held from March through October, a D.S.T. position mark 562 is marked on the ornamental plate 56 at the location of 11:30. While adjusting the time subject to the local daylight saving time, rotating the landmark ring or the spherical global to move the time zone adjustable ring 52 synchronously to have the landmark of the set city to be aligned with the position of the position mark 562 of the ornament plate 56, thereby eliminating a complicated procedure of adjusting the first hour hand 431.

Another advantage of the present invention is that, after adjusting to the local time (the time of first location), in accordance with the aforesaid procedures, the user can reference to a specified time zone, for example the time difference of the New Delhi, India and the local time zone is 2.5 hours, so when the local time is 12 o'clock at noon, the user can turn the second adjustment knob 36 for enabling the second driven wheel 361 to drive the second front hour wheel 42, the second minute wheel set 33 and the second hour wheel 44 to be aligned with the local time (the time of second location), for example 9:30 in the morning. In addition, if the user wants to know the time in Tokyo, Japan or Jakarta, Indonesia, it is only necessary to normally or reversely turn the time zone adjustable ring 52 to let the user be informed that it is 1 o'clock in the afternoon in Tokyo, Japan and 11 o'clock in the morning in Jakarta, Indonesia. The second front hour wheel 42, the second minute wheel set 33 and the second hour wheel 44 are not affected by the normal or reverse rotation of the time zone adjustable ring 52 because of their independent operations, thus the time (the time of second location) in Jakarta, Indonesia still shows at 9:30 in the morning. What shall be addressed is that the time of second location is not limited to the specified time zones, the user can also adjust to other typical time zones of other cities, such as London, British.

As shown from FIG. 7 to FIG. 9, wherein FIG. 7 is a partially perspective exploded view showing the timer movement, according to the second embodiment of the present invention; FIG. 8 is a schematic view showing the assembly after each component being installed on the top of the faceplate of the timer movement of FIG. 7, according to the second embodiment of the present invention; and FIG. 9 is a perspective view showing the assembly of the timer movement, according to the second embodiment of the present invention. The second embodiment of the timer movement provided by the present invention also comprises a power source 1, a second counter 2, a minute counter 3, an hour counter 4, and a time zone display 5, and a day-night display 6. For providing full disclosure, the same components adopted in the first and the second embodiments are provided with the same terms and codes.

As shown in FIG. 7 and FIG. 8, the power source 1, the second counter 2, the minute counter 3, and the major portion of the hour counter 4 have been disposed between the cover plate 7 and the fasten base 34. The different between this embodiment and the previous embodiment is that, the bottom periphery of the fasten base 34 is concentrically and axially formed with a plurality of sleeve holes 342 preferably arranged with equal intervals, then at least two elastic positioning balls 38, e.g. three elastic positioning balls 38, are axially and equiangularly sleeved in the selected sleeve holes 342 for being positioned, such that the ball bodies 381 are exposed out of the sleeve holes 342. The time zone adjustable ring 52 is installed with an inner gear ring 522, the bottom periphery is annularly and equiangularly formed with 24 positioning holes 523 for allowing the ball bodies 381 of the at least two elastic positioning balls 38 to be buckled and positioned.

FIG. 9 is a perspective view showing the assembly of the timer movement, according to the second embodiment of the present invention. The difference between this embodiment and the previous embodiment is that, the elastic positioning balls 38 received in the sleeve holes 342 at the bottom of the fasten base 34 and the positioning holes 523 of the time zone adjustable ring 52 are radially or axially buckled and positioned without affecting the bidirectional rotation function of the time zone adjustable ring 52.

It is appreciated that the advantages of the present invention can be summarized hereinafter:

(1) It provides a means of adjusting world time zones with a bidirectional rotation manner. Instead of the unidirectional ratchet holes adopted in prior arts, the rotary time zone adjustable ring and the fasten base, serving as a fasten component, are buckled and positioned by the positioning holes and the elastic positioning balls, such that the time zone adjustable ring is provided with a bidirectional rotating and positioning function, which can be utilized to rapidly adjust to a desired time zone, and immediately display the time of the specified time zone, thereby providing convenience in use.

(2) It provides a function of displaying the time of second location. The second minute wheel set, the second front hour wheel and the second hour wheel synchronously driven by the front minute wheel are independently operated and not affected by the normal or reverse rotation of the time zone adjustable ring, so the user can adjust the second timer to the time of second location according to his/her own needs.

(3) It is easy for the user to read the time. Because the present invention adopts a 12-hour movement to display the time so that the local time and other time zones can be easily read without changing the accustomed way for reading the time.

(4) It is easily operated and offers accurate time information. In case of other time zones being checked, it is only necessary to turn the time zone adjustable ring such that the first front hour wheel of the hour counter can perform planetary motion on the planetary base gear and it is possible for the first front hour wheel of the hour counter to move along with exact hour graduation for the specific time at both places respectively or for the time difference between both places being distinguishable easily and conveniently. In addition, the present invention utilizes a stepping motor for outputting power, thereby preventing the time deviation.

(5) It provides a function of day-night reading. The difference between decoration marks shown on the day-night display disk driven by the day-night gear is possible for the user to differentiate the state of daytime or nighttime for a specified time zone easily.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A timer movement with a display for world time zones, comprising a power source, a second counter, a minute counter, an hour counter and a time zone display, so as to display a correct time of a specified time zone on a faceplate; wherein, said second counter driving a front minute wheel of said minute counter to rotate, said front minute wheel meshing with a first minute wheel set pivoted on a fasten base and having a first minute hand; a time zone adjustable ring of said time zone display being disposed between said fasten base and said faceplate; and a planetary idle gear and a planetary driven gear being pivoted on said faceplate and mutually meshed; said planetary idle gear and said planetary driven gear being respectively engaged with an inner gear ring of said time zone adjustable ring and a planetary base gear pivoted at the central bottom of said fasten base, said planetary base gear allowing said first minute wheel set to pass over and meshing with a first front hour wheel of said hour counter pivoted at the bottom of said planetary base gear; said first front hour wheel further meshing with a first hour wheel pivoted on said faceplate and having a first hour hand; and the periphery of a round disk at the bottom of said fasten base being radially or axially formed with a plurality of sleeve holes, at least two elastic positioning balls being sleeved and positioned in said selected sleeve holes, the periphery of inner wall or the bottom periphery of said time zone adjustable ring being annularly and equiangularly formed with 24 positioning holes for buckling and positioning said elastic positioning balls, such that said time zone adjustable ring being enabled to bidirectionally rotate;

by aligning the landmark of local time zone with a fixed point for calibrating the local time, then turning said time zone adjustable ring to a landmark of another time zone to be aligned with said fixed point, said inner gear ring of said time zone adjustable ring driving said planetary idle gear, said planetary driven gear and said planetary base gear to rotate, and each elastic positioning ball being sequentially buckled and positioned along each positioning hole, and said first front hour wheel being enabled to perform planetary motion about said first minute wheel set on said planetary base gear, so as to rotate said first hour wheel meshed therewith for displacing said first hour hand to display the time of a first location at the landmark of another time zone.

2. The timer movement with a display for world time zones according to claim 1, wherein a second minute wheel set meshes with said front minute wheel of said minute counter, pivoted on said fasten base and having a second minute hand, said second minute wheel set further meshes with a second front hour wheel pivoted on said fasten base, said second front hour wheel further meshes with a second hour wheel pivoted on said fasten base and penetrating said faceplate and having a second hour hand, so as to display the time of second location.

3. The timer movement with a display for world time zones according to claim 1, wherein said planetary driven gear is composed of a bottom driven gear being sleeved with a top driven gear at the top, and said bottom and said top driven gears respectively mesh with said planetary base gear and a top gear plate of said planetary idle gear, and a bottom gear plate of said planetary idle gear meshes with said inner gear ring of said time zone adjustable ring.

4. The timer movement with a display for world time zones according to claim 1, wherein said power source is fixed on a substrate and has a circuit board, said fasten base is provided with a battery chamber electrically connected to said circuit board for supplying electric power to a stepping motor of said circuit board, such that a rotor of said stepping motor rotates with a constant speed; a front second wheel of said second counter respectively meshes with said rotor and a second wheel, the bottom of said second wheel is downwardly extended with a second spindle and the distal end protrudes on said faceplate for being connected with a second hand/disk; and said second wheel meshes with a front minute wheel pivoted on said substrate.

5. The timer movement with a display for world time zones according to claim 1, wherein said first minute wheel set is constituted by a first minute wheel being moveably sleeved with a first minute wheel spindle for forming as one piece.

6. The timer movement with a display for world time zones according to claim 2, wherein said second minute wheel set is constituted by a second minute wheel being moveably sleeved with a second minute wheel spindle for forming as one piece.

7. The timer movement with a display for world time zones according to claim 1, wherein the quantity of distal end positioning holes annularly and equiangularly formed at the periphery of inner wall or the bottom periphery of said time zone adjustable ring is 24, for corresponding to the 24 time zones.

8. The timer movement with a display for world time zones according to claim 1, further includes a day-night display having a day-night gear pivoted on said faceplate and meshing with said first hour wheel, said day-night gear is pivoted with a day-night display disk at the bottom of said faceplate and having a decoration mark as a symbol to indicate the state of daytime or the state of nighttime.

9. The timer movement with a display for world time zones according to claim 8, wherein the bottom of said faceplate is provided with an ornament plate marked with time scales or patterns, and said ornament plate is formed with a viewing window corresponding to the location of said decoration mark of said day-night display disk.

10. The timer movement with a display for world time zones according to claim 9, wherein a D.S.T. position mark is marked on said ornamental plate at the location of 11:30.

11. The timer movement with a display for world time zones according to claim 1, further includes a first adjustment knob pivoted on said fasten base, the bottom of said first adjustment knob has a first driven wheel, a relay wheel is meshed between said first driven wheel and said first minute wheel set; when turning said first adjustment knob, said relay wheel, said first minute wheel set, said first front hour wheel and said first hour wheel are driven to relatively rotate, so as to adjust the time of first location.

12. The timer movement with a display for world time zones according to claim 2, further includes a second adjustment knob pivoted on said fasten base, the bottom of said second adjustment knob has a second driven wheel, said second front hour wheel is meshed between said second driven wheel and said second minute wheel set; when turning said second adjustment knob, said second front hour wheel, said second minute wheel set, and said second hour wheel are driven to relatively rotate, so as to adjust the time of second location.

13. The timer movement with a display for world time zones according to claim 11, wherein the top of said fasten base is further connected to a cover plate for covering and sealing the top of said fasten base, said cover plate is respectively formed with a first and a second through holes corresponding to the locations of said first and said second adjustment knobs for allowing said first and said second adjustment knobs to be exposed.

14. The timer movement with a display for world time zones according to claim 12, wherein the top of said fasten base is further connected to a cover plate for covering and sealing the top of said fasten base, said cover plate is respectively formed with a first and a second through holes corresponding to the locations of said first and said second adjustment knobs for allowing said first and said second adjustment knobs to be exposed.

* * * * *